US009459569B2

(12) United States Patent
Hirose et al.

(10) Patent No.: US 9,459,569 B2
(45) Date of Patent: Oct. 4, 2016

(54) IMAGE FORMING APPARATUS COUNTING CUMULATIVE NUMBER OF STARTUPS OF FIXING UNIT

(71) Applicant: CANON KABUSHIKI KAISHA, Tokyo (JP)

(72) Inventors: Masaki Hirose, Suntou-gun (JP); Satoru Taniguchi, Mishima (JP); Jun Asami, Susono (JP); Takashi Honke, Mishima (JP); Hirohiko Aiba, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/635,116

(22) Filed: Mar. 2, 2015

(65) Prior Publication Data

US 2015/0253704 A1 Sep. 10, 2015

(30) Foreign Application Priority Data

Mar. 4, 2014 (JP) ..... 2014-041815
Feb. 23, 2015 (JP) ..... 2015-032919

(51) Int. Cl.
*G03G 15/20* (2006.01)
*G03G 21/02* (2006.01)
*G03G 15/00* (2006.01)

(52) U.S. Cl.
CPC ..... *G03G 15/2039* (2013.01); *G03G 15/553* (2013.01); *G03G 2221/1663* (2013.01)

(58) Field of Classification Search
CPC ..... G03G 21/1685; G03G 2221/1663; G03G 15/553
USPC ..... 399/24
See application file for complete search history.

(56) References Cited

U.S. PATENT DOCUMENTS 4,112,747 A * 9/1978 Aldridge ..... G07C 3/00 73/112.01
6,031,621 A * 2/2000 Binder ..... 358/1.1

(Continued)

FOREIGN PATENT DOCUMENTS

JP H11-305579 A 11/1999
JP 2000131978 A * 5/2000

(Continued)

OTHER PUBLICATIONS

U.S. Appl. No. 14/669,517, dated Mar. 26, 2015.

(Continued)

*Primary Examiner* — Clayton E LaBalle
*Assistant Examiner* — Leon W Rhodes, Jr.
(74) *Attorney, Agent, or Firm* — Fitzpatrick, Cella, Harper & Scinto

(57) ABSTRACT

An image forming apparatus that forms a toner image on a recording medium includes a fixing unit configured to fix the unfixed toner image on the recording medium while conveying the recording medium bearing the unfixed toner image at a nip portion. The fixing unit includes a fixing rotating member and a pressure member forming the nip portion with the fixing rotating member. The apparatus also includes: a counting portion configured to count the cumulative rotation time of the fixing rotating member and the cumulative number of startups of the fixing unit; and a notifying portion configured to performing notification of information about at least one of the lifetime expiration of the fixing unit and the necessity of replacing the fixing unit. The notifying portion performs the notification in accordance with the cumulative rotation time and the cumulative number of startups of the fixing unit.

12 Claims, 7 Drawing Sheets

(56) References Cited

U.S. PATENT DOCUMENTS

| | | | | |
|---|---|---|---|---|
| 6,993,270 | B2 * | 1/2006 | Yoshioka et al. | 399/162 |
| 7,376,379 | B2 * | 5/2008 | Takahashi et al. | 399/329 |
| 7,389,079 | B2 | 6/2008 | Narahara et al. | |
| 7,499,655 | B2 * | 3/2009 | Yamauchi et al. | 399/24 |
| 7,734,200 | B2 * | 6/2010 | Sugiyama et al. | 399/24 |
| 7,869,905 | B2 * | 1/2011 | Gross et al. | 700/300 |
| 8,086,120 | B2 * | 12/2011 | Thayer et al. | 399/34 |
| 8,432,160 | B2 * | 4/2013 | Smargiassi | 324/226 |
| 8,471,178 | B2 | 6/2013 | Taniguchi et al. | |
| 8,600,259 | B2 | 12/2013 | Oi et al. | |
| 8,791,390 | B2 | 7/2014 | Taniguchi | |
| 2006/0157464 | A1 | 7/2006 | Omata et al. | |

FOREIGN PATENT DOCUMENTS

| | | | |
|---|---|---|---|
| JP | 2006-163017 | A | 6/2006 |
| JP | 2006330179 | A * | 12/2006 |
| JP | 2007-309980 | A | 11/2007 |
| JP | 2010-002528 | A | 1/2010 |

OTHER PUBLICATIONS

U.S. Appl. No. 14/670,843, dated Mar. 27, 2015.

* cited by examiner

IMAGE FORMING APPARATUS COUNTING CUMULATIVE NUMBER OF STARTUPS OF FIXING UNIT

BACKGROUND OF THE INVENTION

1. Field of the Invention

The present invention relates to an image forming apparatus using electrophotography such as a copier and a printer.

2. Description of the Related Art

The fixing apparatus equipped in an image forming apparatus is desired to be usable over a long time without any problems associated with the fixing process. It is therefore important to improve the accuracy of predicting the lifetime of the fixing apparatus so that the user is prompted to replace the fixing apparatus in an appropriate period. In the fixing apparatus, a fixing rotating member forms a nip portion where recording media are heated as they are conveyed, and rubs against another component at this nip portion. It has been known that the sliding surface of the fixing rotating member deteriorates more with the increase in the number of recording media passed through the nip portion or the number of rotations of the fixing rotating member.

It has been practice to monitor the number of recording media or the rotation time of the fixing rotating member, and to prompt a replacement of the fixing apparatus on an operation panel when a prescribed number of sheets or rotation time is reached, on the basis of which it is assumed that the fixing apparatus's lifetime has expired. The end of lifetime of the fixing apparatus can also be detected, as disclosed by Japanese Patent Application Laid-open No. H11-305579, by monitoring the duration of power application by power application means to heating means.

However, an image forming apparatus that can detect the end of lifetime of the fixing apparatus even more accurately than these configurations is being desired.

SUMMARY OF THE INVENTION

According to a first preferred embodiment of the present invention, an image forming apparatus that forms a toner image on a recording medium includes: an image forming unit configured to form an unfixed toner image on the recording medium; a fixing unit configured to fix the unfixed toner image on the recording medium while conveying the recording medium bearing the unfixed toner image at a nip portion, the fixing unit including a fixing rotating member and a pressure member forming the nip portion with the fixing rotating member; a counting portion configured to count cumulative rotation time of the fixing rotating member and a cumulative number of startups of said fixing unit; and a notifying portion configured to notify information about at least one of lifetime expiration of the fixing unit and necessity of replacing the fixing unit, wherein the notifying portion notifies the information in accordance with the cumulative rotation time and the cumulative number of startups.

According to a second preferred embodiment of the present invention, an image forming apparatus that forms a toner image on a recording medium includes: an image forming unit configured to form an unfixed toner image on the recording medium; a fixing unit configured to fix the unfixed toner image on the recording medium while conveying the recording medium bearing the unfixed toner image at a nip portion, the fixing unit including a fixing rotating member and a pressure member forming the nip portion with the fixing rotating member; a counting portion configured to count cumulative rotation time of the fixing rotating member and a cumulative number of startups of the fixing unit; and a notifying portion configured to notify information about at least one of lifetime expiration of the fixing unit and necessity of replacing the fixing unit, wherein the larger the cumulative number of startups is, the earlier the notifying portion notifies the information in a case where the cumulative rotation time is the same.

According to a third preferred embodiment of the present invention, an image forming apparatus that forms a toner image on a recording medium includes: an image forming unit configured to form an unfixed toner image on the recording medium; a fixing unit configured to fix the unfixed toner image on the recording medium while conveying the recording medium bearing the unfixed toner image at a nip portion, the fixing unit including a fixing rotating member and a pressure member forming the nip portion with the fixing rotating member; a counting portion configured to count cumulative rotation time of the fixing rotating member, a cumulative number of startups of the fixing unit, and a cumulative number of printed sheets; and a notifying portion configured to notify information about at least one of lifetime expiration of the fixing unit and necessity of replacing the fixing unit, wherein the cumulative rotation time is corrected such that the larger the cumulative number of startups is, the longer the cumulative rotation time is, and wherein the notifying portion notifies the information at an earlier timing of when the cumulative number of printed sheets reaches a threshold and when the cumulative rotation time that has been corrected reaches a threshold, whichever takes place earlier.

According to a fourth preferred embodiment of the present invention, an image forming apparatus that forms a toner image on a recording medium includes: an image forming unit that forms an unfixed toner image on the recording medium; a fixing unit configured to fix the unfixed toner image on the recording medium while conveying the recording medium bearing the unfixed toner image at a nip portion, the fixing unit including a fixing rotating member and a pressure member forming the nip portion with the fixing rotating member; a counting portion configured to count a cumulative number of rotations of the fixing rotating member and a cumulative number of startups of the fixing unit; and a notifying portion configured to notify information about at least one of lifetime expiration of the fixing unit and necessity of replacing the fixing unit, wherein the notifying portion notifies the information in accordance with the cumulative number of rotations and the cumulative number of startups.

According to a fifth preferred embodiment of the present invention, an image forming apparatus that forms a toner image on a recording medium includes: an image forming unit that forms an unfixed toner image on the recording medium; a fixing unit configured to fix the unfixed toner image on the recording medium while conveying the recording medium bearing the unfixed toner image at a nip portion, the fixing unit including a fixing rotating member and a pressure member forming the nip portion with the fixing rotating member; a counting portion configured to count a cumulative number of rotations of the fixing rotating member and a cumulative number of startups of the fixing unit; and a notifying portion configured to notify information about at least one of lifetime expiration of the fixing unit and necessity of replacing the fixing unit, wherein, the larger the cumulative number of startups is, the earlier the notifying portion notifies the information in a case where the cumulative number of rotations is the same.

According to a sixth preferred embodiment of the present invention, an image forming apparatus that forms a toner image on a recording medium includes: an image forming unit that forms an unfixed toner image on the recording medium; a fixing unit configured to fix the unfixed toner image on the recording medium while conveying the recording medium bearing the unfixed toner image at a nip portion, the fixing unit including a fixing rotating member and a pressure member forming the nip portion with the fixing rotating member; a counting portion configured to count a cumulative number of rotations of the fixing rotating member, a cumulative number of startups of the fixing unit, and a cumulative number of printed sheets; and a notifying portion configured to notify about information about at least one of lifetime expiration of the fixing unit and necessity of replacing said fixing unit, wherein the cumulative number of rotations is corrected such that, the larger the cumulative number of startups is, the larger the cumulative number of rotations is, and wherein the notifying portion notifies the information at an earlier timing of when the cumulative number of printed sheets reaches a threshold and when the cumulative number of rotations that has been corrected reaches a threshold, whichever takes place earlier.

Further features of the present invention will become apparent from the following description of exemplary embodiments (with reference to the attached drawings).

DESCRIPTION OF THE EMBODIMENTS

Modes for carrying out this invention will be hereinafter illustratively described in detail with reference to the drawings.

Embodiment 1

Embodiment 1 will be described below.

(1) Image Forming Apparatus

Figure 1:
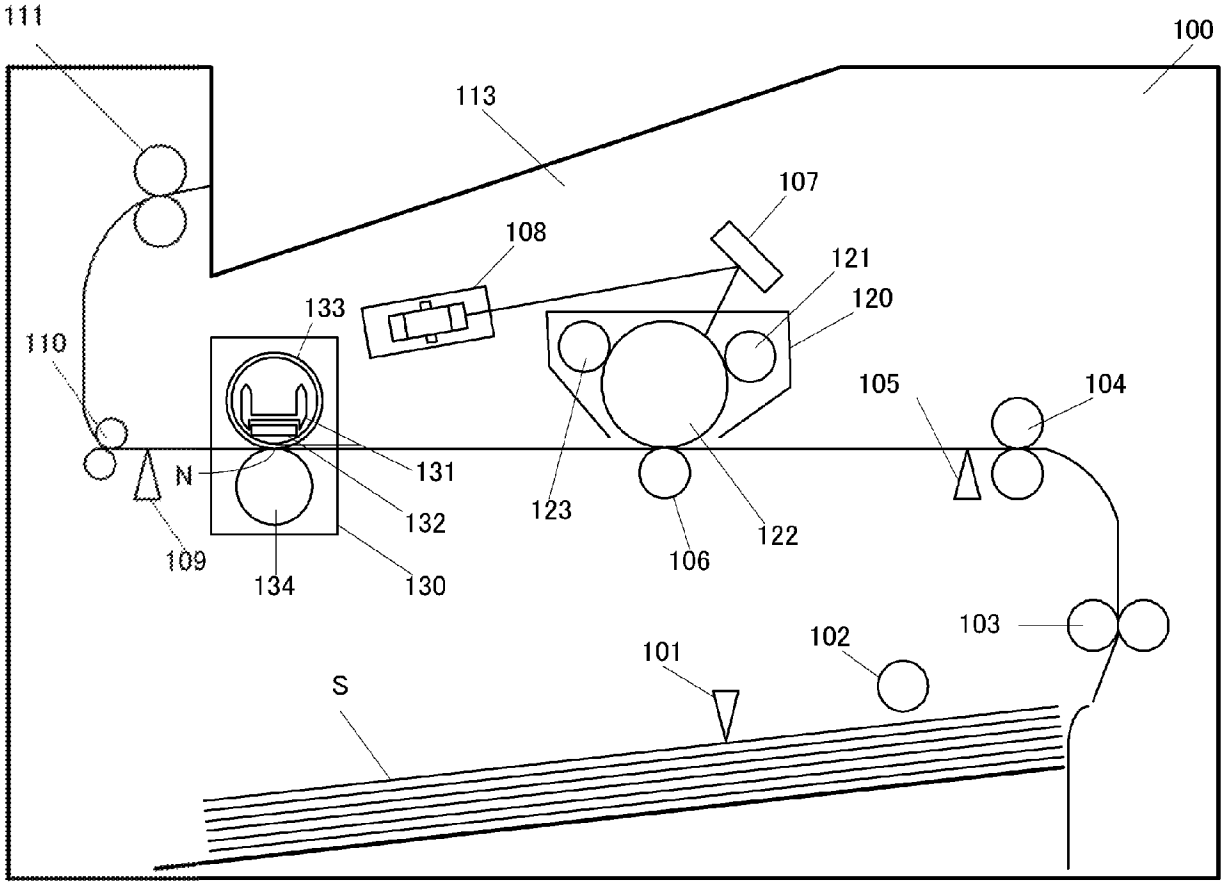
FIG. 1 is a schematic configuration diagram of an image forming apparatus of Embodiment 1.

FIG. 1 is a cross-sectional view illustrating the schematic configuration of the image forming apparatus of this embodiment. The general configuration of the image forming apparatus and its printing operation (image forming operation) will be described with reference to FIG. 1.

As shown in FIG. 1, the image forming apparatus 100 of this embodiment includes a toner cartridge 120 removably mounted in the main body of the image forming apparatus. The toner cartridge 120 includes a developing roller 121, a photosensitive drum 122, and a charging roller 123.

Once printing is started, first, the photosensitive drum 122 is charged uniformly to a predetermined potential by the charging roller 123. A laser beam emitted from an optical laser 108 and reflected by a laser reflection mirror 107 is projected on this charged surface. The laser is modulated (on/off controlled) corresponding to time-sequential electrical digital pixel signals of target image information input from an image signal generation apparatus (not shown) such as an image reading apparatus or a computer.

A latent image (electrostatic latent image) corresponding to the image information is produced on the surface of the photosensitive drum by laser scanning exposure. Sub scanning direction synchronous signals are sent to the image signal generation apparatus by the image forming apparatus to instruct when to start scanning exposure in the sub scanning direction. The latent image formed this way corresponding to the target image is developed by the developing roller 121.

Next, when a recording medium sensor 101 detects presence of recording media in a feeder cassette, a sheet of recording media S is fed out by a feeding roller 102, and transferred by conveyor rollers 103 and registration rollers 104. A top sensor 105 detects the leading end of the recording medium S so that it is synchronized with the toner image formed on the photosensitive drum 122 as the medium is conveyed to the nip portion between the photosensitive drum 122 and a transfer roller 106. The transfer roller 106 charges the back of the recording medium S to an opposite polarity from the normal charge polarity of the toner to transfer the toner image from the photosensitive drum 122 onto the recording medium S.

Above described compositions for forming unfixed toner image on the recording medium S correspond to an image forming unit of the present invention.

After receiving the toner image, the recording medium S is separated from the photosensitive drum 122, and sent into the fixing apparatus 130, which is provided as an image heating device, where heat and pressure are applied as the recording medium S is passed through the tight nip portion N to fix the unfixed toner image thereon.

When a discharge sensor 109 detects passage of the leading end of the recording medium S after the fixing process, face-up rollers 110 and face-down rollers 111 convey the recording medium S out to a face-down tray 113, whereupon one cycle of printing operation is complete.

According to the specifications of the image forming apparatus used in this embodiment, the process speed is 350 mm/sec, the throughput speed of A4 size paper in portrait orientation is 60 ppm, and the FPOT is 10 sec.

(2) Fixing Apparatus 130

Next, the fixing apparatus 130 according to this embodiment will be described.

Figure 4:
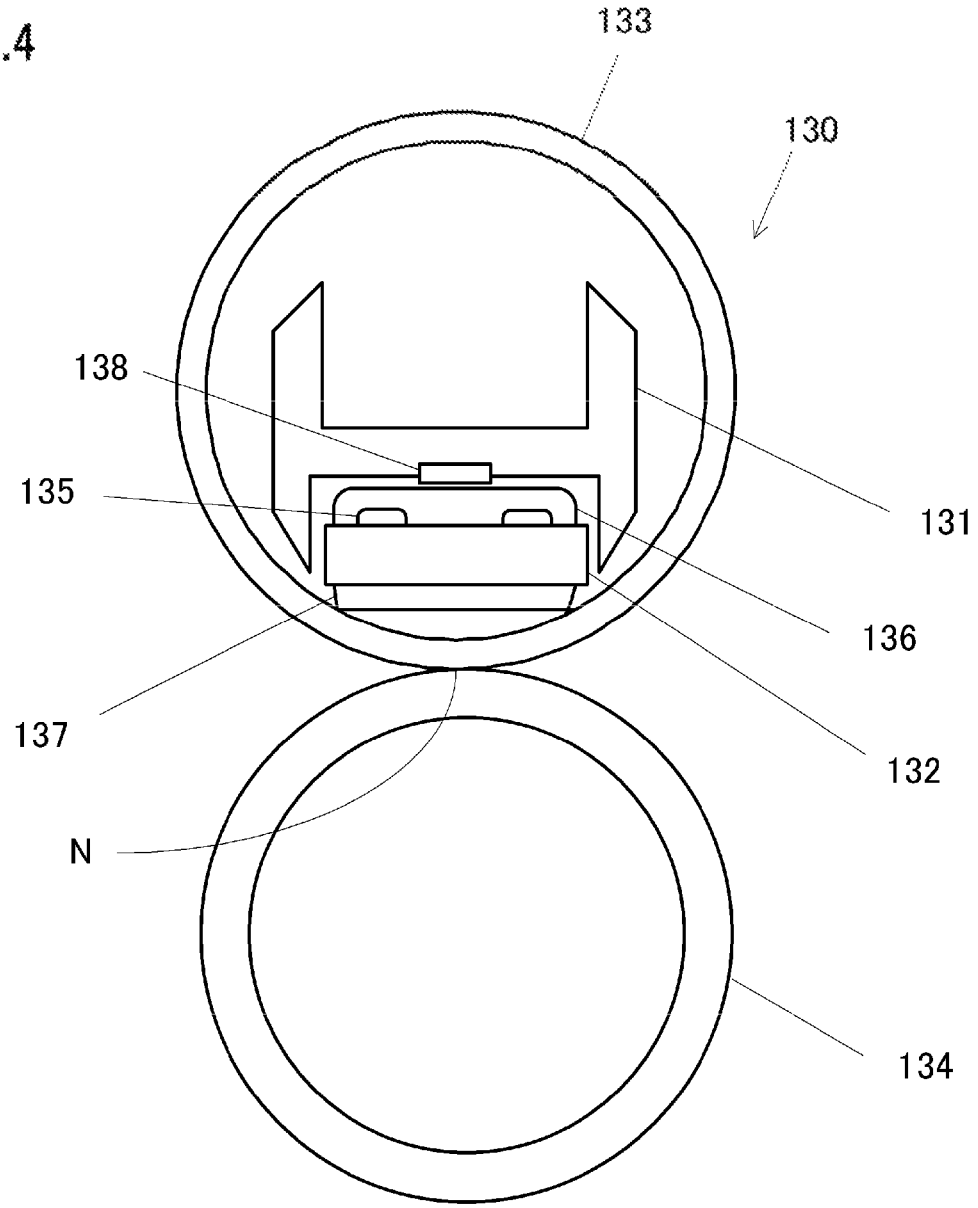
FIG. 4 is a schematic configuration diagram of the fixing apparatus of Embodiment 1.

FIG. 4 is a cross-sectional view illustrating the schematic configuration of the fixing apparatus 130 that uses a film according to this embodiment.

The fixing apparatus 130 includes a heater 132, a guide member 131 that holds the heater 132, a tubular film 133 disposed around the guide member 131, and a pressure roller 134 provided as a pressure member. The nip portion N is formed between the film 133 and the pressure roller 134 at a position where the heater 132 faces the film 133. The film 133 and pressure roller 134 here correspond to a pair of rotating members that make pressure contact with each other to form the nip portion N. The heater 132 corresponds to a (slidable) sliding member disposed on an inner circumferential side of the film 133 to make sliding contact with the film 133.

(2-1) Guide Member 131

The guide member 131 is a heat resistant resin component formed to have a substantially semicircular cross section. The guide member not only supports the heater 132 but also serves as a conveyor guide for the film 133.

The guide member 131 may be made of resin having excellent processability and high heat resistance such as polyimide, polyamide-imide, PEEK, PPS, liquid crystal polymer and the like, or a composite material of any of these resins, ceramics, metal, glass, and the like. In this embodiment, liquid crystal polymer is used. PEEK stands for polyetheretherketone and PPS stands for polyphenylene sulfide.

(2-2) Heater 132

The heater 132, provided as a nip portion forming member (sliding plate), will be described. A commonly used ceramic heater is used as the heater 132. The substrate is made of ceramic with good thermal conductivity and electrical insulation properties such as alumina, aluminum nitride and the like. The ceramic substrate (hereinafter, "substrate") has an appropriate thickness of about 0.5 to 1.0 mm to minimize thermal capacity, and is formed in a rectangular shape of about 10 mm width and about 300 mm length.

A heat generating resistance 135 is formed along a longitudinal direction on one side (backside) of the heater 132. The heat generating resistance 135 is mainly composed of silver/palladium alloy, nickel/tin alloy, ruthenium oxide alloy and the like, and is formed to have a thickness of about 10 μm and a width of about 1 to 5 mm by screen printing or the like.

A layer of insulating glass 136 is formed upon the substrate and heat generating resistance 135. The insulating glass 136 provides electrical insulation between the heat generating resistance 135 and an external conductive member (not shown), as well as prevents mechanical damage thereof. The insulating glass may have an appropriate thickness of about 20 to 100 μm.

The other side (front side) of the heater 132 forms a sliding surface that makes sliding contact with the film 133, with a sliding layer 137 formed as a film on the surface of the substrate. The sliding layer 137 may be made of an organic compound having water and oil repellency, heat resistance, wear resistance, and lubricity. The sliding layer 137 in this embodiment is made of polyimide coated to a thickness of 6 μm.

(2-3) Film 133

The film 133 as the fixing rotating member is disposed around the guide member 131 that holds the heater 132. The film 133 has a longer inner circumference than the outer circumference of the guide member 131 that holds the heater 132 (longer by about 3 mm in this embodiment). Thus, the film 133 is fitted around the guide member 131 with play in the circumferential direction.

The film 133 may be a 20 to 70 μm thick single layer film, or a composite layer film, of PTFE, PFA, FEP, and the like, having heat resistance, for efficient transfer of heat from the heater 132 to the recording medium S as a heated member at the nip portion N. The commonly used composite layer film has a base layer of polyimide, polyamide-imide, PEEK, PES, PPS, or SUS, an elastic layer formed on the base layer and made of an elastic material such as silicone rubber for improving fixing performance, with a heat conductive filler such as ZnO, $Al_2O_3$, SiC, metallic silicon and the like mixed therein, and a coating of PTFE, PFA, FEP and the like on the outermost surface. The film used in this embodiment has a 40 μm thick base layer of SUS, a 240 μm thick composite layer of silicone rubber and a heat conductive filler as the elastic layer, and a PTFE coating on the outermost surface. PTFE stands for polytetrafluoroethylene, PFA stands for tetrafluoroethylene-perfluoroalkylvinylether copolymer, FEP stands for tetrafluoroethylene-hexafluoropropylene copolymer, and PES stands for polyethersulfone.

(2-4) Pressure Roller 134

The pressure roller 134 is a member that forms the nip portion N between itself and the heater 132 via the film 133, as well as drives the film 133 to rotate.

The pressure roller 134 is an elastic roller having a metal core of SUS, SUM, Al or the like, and an elastic layer formed around the metal core and made of heat resistant rubber such as silicone rubber or fluorocarbon rubber, or foamed silicone rubber. The pressure roller 134 may further have a layer of PFA, PTFE, FEP and the like on the elastic layer for providing release properties. In this embodiment, aluminum is used for the core, silicone rubber is used for the elastic layer of 4.0 mm thickness, and PFA is used for the release layer of 50 μm thickness.

(3) Control Unit

Figure 2:
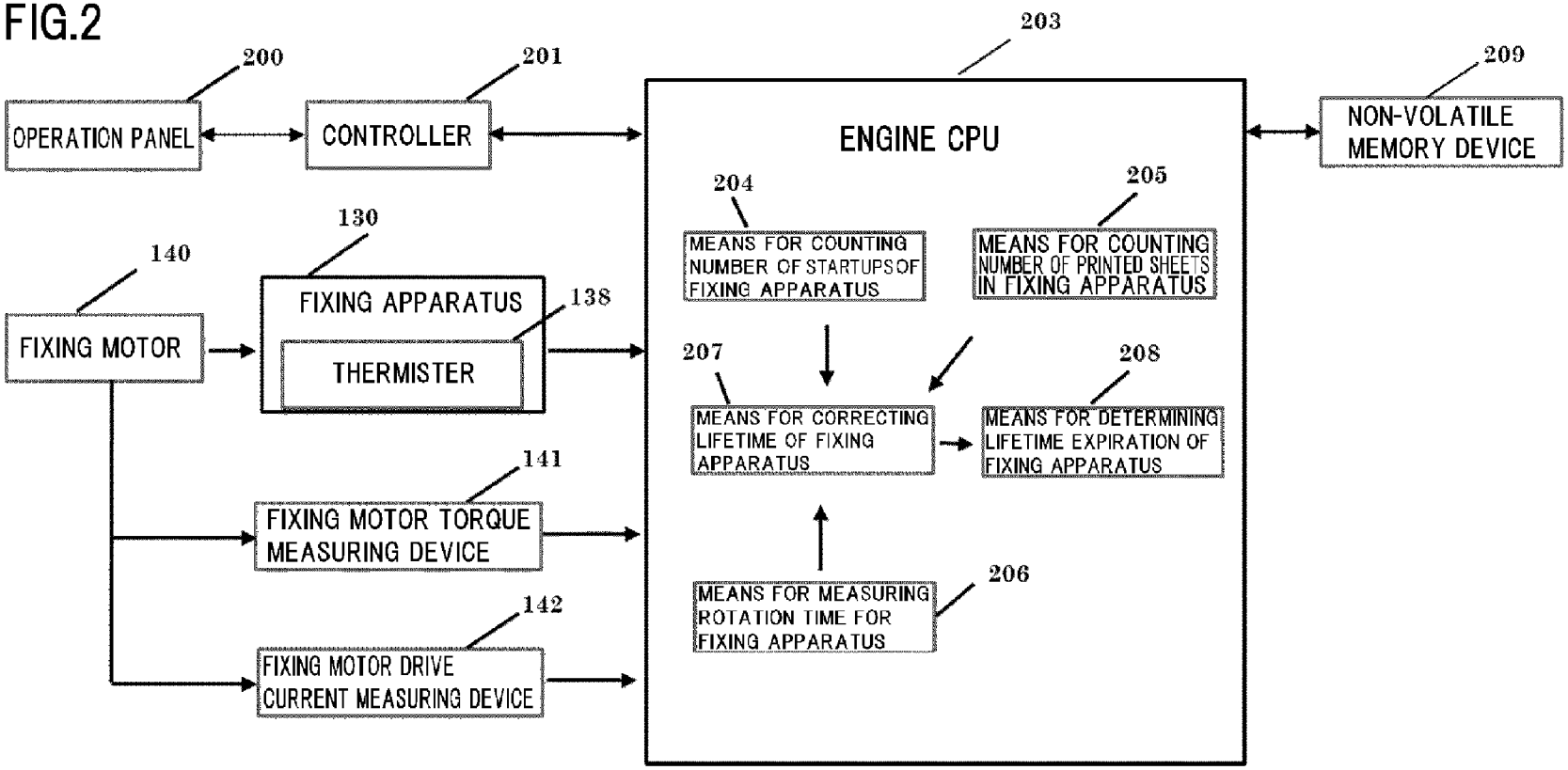
FIG. 2 is a block diagram illustrating the configuration of a control unit in the image forming apparatus of Embodiment 1.

FIG. 2 is a block diagram illustrating the configuration of the control unit in the image forming apparatus 100 of this embodiment.

A fixing motor 140 shown in FIG. 2 is a motor for driving the fixing apparatus 130. A torque measuring device 141 determines a torque necessary for driving the fixing apparatus 130 (drive load), and corresponds to torque information acquiring means that acquires information on drive torque. A fixing motor drive current measuring device 142 determines a current that flows when the fixing motor 140 drives the fixing apparatus 130. These processes are controlled by an engine CPU 203 (FIG. 2) to be described later.

The configuration of the control unit of the image forming apparatus 100 will be described with reference to FIG. 2.

An operation panel 200 is an input device for a user to operate the image forming apparatus 100. Operations such as selection of the size of recording medium can be carried out by following the instructions displayed on the screen of the operation panel 200. A controller 201 serves the functions of processing user operation inputs from the operation panel 200 and information of an image to be printed that is sent from an external device (not shown) via communication means, and of transmitting the information to the engine CPU 203.

The engine CPU 203 includes means for counting the number of startups (first counting portion) 204 that counts the cumulative number of startups M1 of the fixing apparatus 130, means for counting the number of printed sheets (second counting portion) 205 that counts the cumulative number of printed sheets (cumulative number of prints) in the fixing apparatus 130, and means for measuring rotation time (third counting portion) 206 that measures the cumulative rotation time T1 for the fixing apparatus 130. The engine CPU 203 corrects the determined cumulative number of printed sheets and cumulative rotation time T1 by correcting means 207 based on the cumulative number of startups M1, and determines, by means of determination means 208, whether or not the lifetime of the fixing apparatus 130 has expired, based on the corrected value. The correcting means 207 provided in the engine CPU 203 corresponds to correcting means that corrects the time point determined as the end of lifetime of the fixing apparatus 130. The determination means 208 provided in the engine CPU 203 corresponds to lifetime determination means that determines the lifetime of the fixing apparatus 130 based on the information on the lifetime of the fixing apparatus 130.

If the lifetime of the fixing apparatus 130 has expired, a notifying portion of the operation panel 200 implement notifying that prompts the user to replace the fixing apparatus 130. If the lifetime has not expired yet, the remaining lifetime of the fixing apparatus 130 may be made known to the user by, for example, displaying the remaining lifetime by percentage on the operation panel 200. Such information can also be stored in the apparatus even when no power is supplied thereto by recording it in a non-volatile memory device 209.

(4) Prediction of Lifetime of Fixing Apparatus

The main cause of abrasion on sliding surfaces after the lifetime of the fixing apparatus 130 has expired is the rubbing between the sliding plate (heater 132 in this embodiment) and the fixing rotating member that surrounds the sliding plate (film 133 in this embodiment). Therefore, the sliding surfaces are more prone to abrasion with the increase in the running distance of the rotating member, as it means that the rotating member and the sliding plate rub against each other for a longer time. It follows then that the amount of abrasion on the sliding surfaces can be predicted by measuring, and using, the period of time in which the rotating member and the sliding plate rub against each other. The sliding surfaces here refer to the inner surfaces of the sliding plate and the rotating member. The amount of abrasion on these surfaces can be predicted on the basis of the abrasion of the member that abrades more easily because of its material. The sliding time can be represented simply by the cumulative number of sheets of recording media S (number of sheets passed, or number of printed sheets), or the cumulative rotation time of the rotating member.

Figure 3:
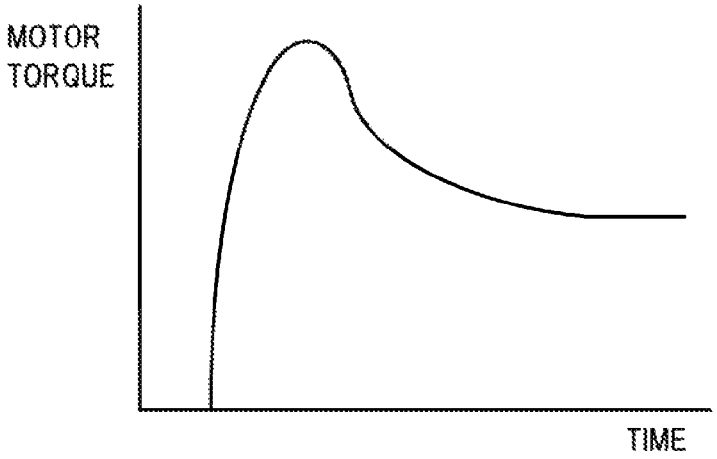
FIG. 3 is a diagram showing changes in the drive torque when the fixing apparatus of Embodiment 1 is started.

The abrasion on the sliding surfaces is also largely affected by the drive torque of the fixing apparatus 130 when it is started. The change in the drive torque when the fixing apparatus 130 is started is shown in FIG. 3.

The drive torque immediately after the start of the fixing apparatus is very large due to the static friction generated when the fixing apparatus 130 that was stopped startups to move. Frictional force acts also during a continuous drive, but since the dynamic friction is smaller than the static friction, the drive torque during the drive of the fixing apparatus is smaller than the torque immediately after the start. The drive torque, therefore, as shown in FIG. 3, assumes a curve with a peak immediately after the start and a subsequent gradual decline. The larger the drive torque, the more the sliding surfaces are damaged, i.e., the more they are abraded.

Since the drive torque is larger immediately after the start than during the drive of the fixing apparatus, the torque immediately after the start has more impact on abrasion of sliding surfaces. Therefore, the sliding surfaces are more prone to abrasion in intermittent paper feeding, wherein, for example, the fixing apparatus is started for each time one sheet of recording media is passed through. Conversely, in continuous paper feeding, wherein, with the apparatus being started once, a plurality of recording media are passed through continuously, the sliding surfaces are abraded less because the fixing apparatus is started a fewer number of times for the cumulative number of sheets passed through, so that the notifying about lifetime expiration can be delayed and the fixing apparatus can be used for a longer time.

The present inventors have considered the possibility of changing the time point determined as the end of the lifetime by predicting the amount of abrasion on the sliding surfaces in the fixing apparatus based on the information on the lifetime of the fixing apparatus such as the running distance or rotation time of the rotating member in the fixing apparatus, or the cumulative number of sheets of recording media S passed through the apparatus, and the information on the cumulative number of startups of the fixing apparatus. This embodiment is characterized in that correction is made to the cumulative rotation time T1 of the rotating member in accordance with the cumulative number of startups M1 of the fixing apparatus 130, and it is determined that the lifetime has expired when the corrected value (first corrected lifetime information) reaches a threshold, whereupon a notifying the information about relating to lifetime expiration is implemented.

(5) Prediction of Lifetime According to this Embodiment

Figure 5:
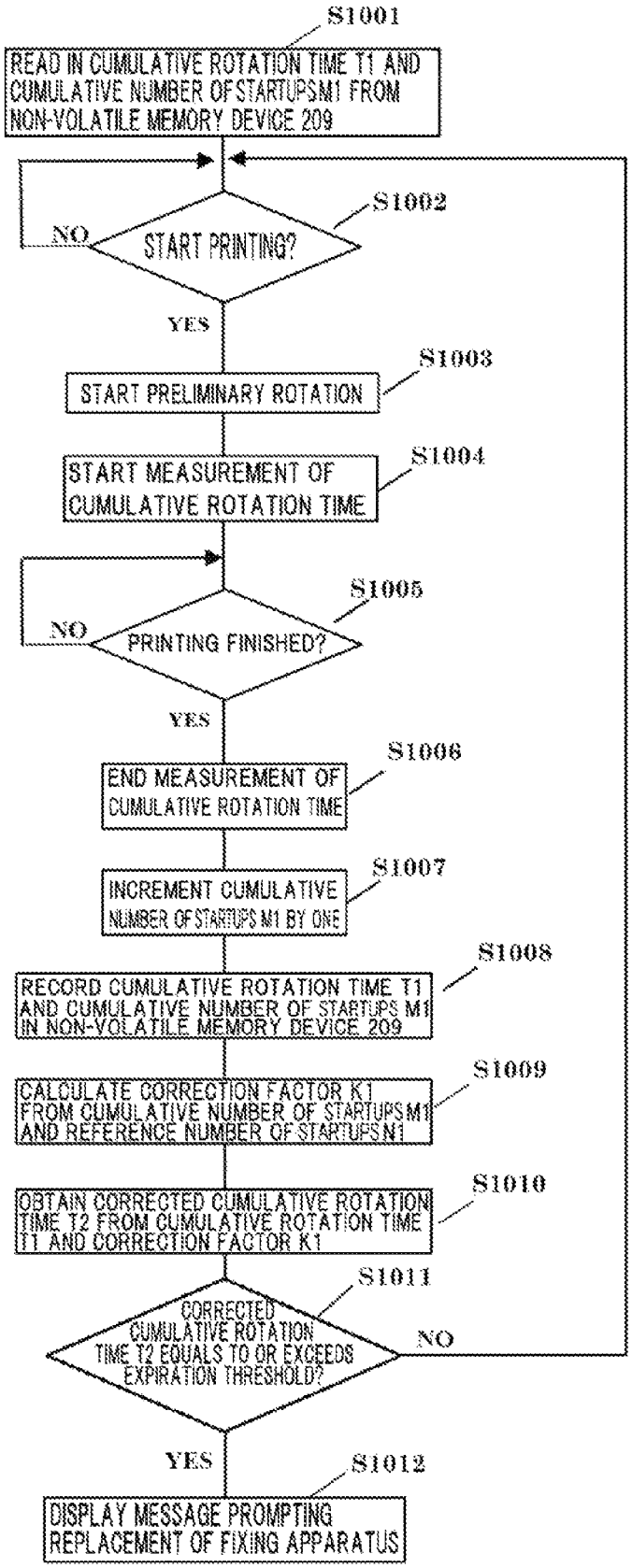
FIG. 5 is a flowchart of a process of predicting the lifetime of the fixing apparatus of Embodiment 1.

FIG. 5 is a flowchart of a process of predicting the lifetime of the fixing apparatus 130.

The process of predicting the lifetime with the use of the cumulative number of startups M1 and cumulative rotation time T1 of the fixing apparatus 130 will be described more specifically below in accordance with the flowchart of FIG. 5.

A series of actions are referred to as a "job" here, wherein "the fixing apparatus 130 is started after an instruction to start printing (instruction to form an image) is received, and driven with power for preliminary rotation to warm up the film and pressure roller inside in advance. When ready, printing is performed. After the completion of printing of a predetermined number of sheets, the fixing apparatus 130 is stopped." The number of startups of the fixing apparatus 130 is counted once per one job. The cumulative number of startups M1 is the number of startups summed up every time a job is performed.

Note the item "reference number of startups N1" in the flowchart of FIG. 5. This reference number of startups N1 is a roughly determined number of times of starting the fixing apparatus 130 until its lifetime expires due to abrasion of sliding surfaces provided that the sheets have been fed in reference conditions. The reference number of startups N1 is 64000 times in this embodiment. How this value is so determined will be explained later.

The rotation time of the fixing apparatus 130 here means the "time from the start of the preliminary rotation until the fixing apparatus 130 stops." The cumulative rotation time T1 is the sum of rotation times accumulated every time a job is performed.

The flowchart shown in FIG. 5 will be described below in more specific terms. The process shown in the flowchart of FIG. 5 performed by the engine CPU 203 starts when the power of the image forming apparatus 100 is turned on, and ends when the power is turned off.

First, in step S1001, the cumulative number of startups M1 and cumulative rotation time T1 stored in the non-volatile memory device 209 are read in. Next, in step S1002, it is decided whether or not the printing action shall be started. The process goes to step S1003 if an instruction to start printing has been received, and returns to step S1002 if not. Next, preliminary rotation is started in step S1003, and at the same time, measurement of the cumulative rotation time T1 is started in step S1004. In step S1005 it is determined whether or not printing has been finished, and the process goes to step S1006 if printing has been finished, and returns to step S1005 for determination of completion of printing again if printing has not been finished. In step S1006, as the job is complete, the measurement of the cumulative rotation time T1 is ended. In step S1007, as the job is complete, the cumulative number of startups M1 is incremented by one. In step S1008, the cumulative rotation time T1 and cumulative number of startups M1 are recorded in the non-volatile memory device 209.

In step S1009, the cumulative number of startups M1 is divided by the reference number of startups N1, as shown in Equation (1), to obtain a correction factor K1. Then, in step S1010, the cumulative rotation time T1 is multiplied by the correction factor K1, as shown in Equation (2), to obtain a corrected cumulative rotation time T2 (first corrected lifetime information). In step S1011, it is determined, by determination means 208, whether or not the corrected cumulative rotation time T2 has reached an expiration threshold (of, for example, 250 hours). If T2 has reached the threshold, it is determined that the lifetime of the fixing apparatus 130 has expired, and the process goes to step S1012, where replacement of the fixing apparatus 130 is prompted. If T2 has not reached the threshold, the process returns to step S1002.

$$\text{Correction factor } K1 = \text{Cumulative number of startups } M1 / \text{Reference number of startups } N1 \quad (1)$$

$$\text{Corrected cumulative rotation time } T2 = \text{Cumulative rotation time } T1 \times \text{Correction factor } K1 \quad (2)$$

The corrected cumulative rotation time T2 is obtained through such a correction, wherein the cumulative rotation time T1 is corrected in accordance with the correction factor K1 that is determined based on the cumulative number of startups M1.

If the cumulative number of startups M1 is large, the correction factor K1 is accordingly large, as a result of which the corrected cumulative rotation time T2 is obtained by correcting the cumulative rotation time T1 to be longer than it would be if the correction factor K1 was smaller, so that T2 will reach the expiration threshold earlier. Conversely, if the cumulative number of startups M1 is small, the correction factor K1 is accordingly small, as a result of which the corrected cumulative rotation time T2 is obtained by correcting the cumulative rotation time T1 to be shorter than it would be if the correction factor K1 was larger, so that T2 will reach the expiration threshold later. Namely, the cumulative rotation time is corrected to be longer if the cumulative number of startups M1 is large.

This way, the corrected cumulative rotation time T2 is set so that the time point determined as the end of the lifetime of the fixing apparatus 130 is made earlier, if the cumulative number of startups M1 is larger than the reference number of startups N1. Put differently, the corrected cumulative rotation time T2 is set so that the time point determined as the end of the lifetime of the fixing apparatus 130 is delayed, if the cumulative number of startups M1 is smaller than the reference number of startups N1. Thereby, in a case where the cumulative rotation time T1 is consistent, a notifying relating to the lifetime expiration of the fixing apparatus 130 is implemented earlier if the cumulative number of startups M1 is larger, than when M1 is smaller.

The reference number of startups N1 is a roughly determined number of times of starting the fixing apparatus 130 until its lifetime expires due to abrasion of sliding surfaces provided that the sheets have been fed in reference conditions. This value is determined based on the results of a paper feeding durability test. The test will be described below.

<Test 1>

A large number of sheets were fed to determine the cumulative number of startups and cumulative rotation time of the fixing apparatus with which abrasion occurs on the sliding surfaces.

The image forming apparatus and the fixing apparatus used here were those described in this embodiment. The recording media S used in the test were A4 sheets of paper with 80 g/m$^2$ weight. A job of feeding four sheets of paper successively was repeated. Each job was started at the moment when the temperature at the back of the heater (backside of the heater 132) became 30° C., after the completion of the previous job, the temperature being monitored and determined with a thermistor 138 at the back of the heater. This is for creating constant driving conditions of the fixing apparatus. The test was conducted three times.

The results are shown in Table 1.

TABLE 1

| | Cumulative number of startups with which abrasion occurs on sliding surfaces | Cumulative rotation time with which abrasion occurs on sliding surfaces |
|---|---|---|
| 1st | 64300 times | 232 hours |
| 2nd | 64800 times | 234 hours |
| 3rd | 64600 times | 233 hours |

According to the test, the cumulative number of startups and cumulative rotation time of the fixing apparatus until abrasion occurs on sliding surfaces were about 64000 times and about 230 hours, respectively. Therefore, the reference number of startups N1 was set to be 64000 times for the fixing apparatus 130 of this embodiment.

The reference number of startups N1 was thus determined based on Test 1. Test 2 was then conducted to confirm that a notifying relating to lifetime expiration could be implemented before actual abrasion occurs on the sliding surfaces by using this lifetime expiration prediction method even if the sheets of paper were fed in different ways.

<Test 2>

The number of sheets fed per one job was changed from that of Test 1, and the cumulative number of startups and cumulative rotation time of the fixing apparatus with which abrasion occurs on the sliding surfaces were determined. The numbers of sheets fed per job were 1, 2, and 3.

The results are shown in Table 2.

TABLE 2

| Number of sheets per job | Cumulative number of startups with which abrasion occurs on sliding surfaces | Cumulative rotation time with which abrasion occurs on sliding surfaces | Corrected cumulative rotation time |
|---|---|---|---|
| 1 sheet | 73500 times | 204 hours | 234 hours |
| 2 sheets | 70300 times | 215 hours | 236 hours |
| 3 sheets | 66900 times | 223 hours | 233 hours |
| 4 sheets | 64300 times | 232 hours | 233 hours |

The cumulative number of startups and cumulative rotation time with which abrasion occurs on the sliding surfaces varied depending on the number of sheets passed per one job. Therefore, the cumulative rotation times were corrected based on the cumulative number of startups, with the use of Equation (1) and Equation (2), to obtain the corrected cumulative rotation times. As can be seen, abrasion occurred on the sliding surfaces when the corrected cumulative rotation time exceeded 230 hours.

Based on the two tests described above, in this embodiment, the corrected cumulative rotation time is determined based on a reference number of startups N1 of 64000, and a notifying relating to lifetime expiration is implemented when the corrected cumulative rotation time reaches 230 hours.

According to this embodiment, as described above, the accuracy of predicting the lifetime of the fixing apparatus 130 can be improved, so that the user can be prompted to replace the fixing apparatus before "abrasion occurs on sliding surfaces (abrasion on the inner surface of the heater 132 or film 133)". Therefore, replacement of the fixing apparatus can be prompted more timely depending on the conditions of use (how it is used) by the user.

Next, a variation example of Embodiment 1 will be described. In the variation example of Embodiment 1, the cumulative rotation time T1 and a cumulative number of printed sheets are used for the lifetime prediction for the fixing apparatus 130. The reason why the cumulative number of printed sheets is used for determining the lifetime of the fixing apparatus 130 is to prevent scars on the surface of the film 133 caused by the contact with the recording media sliding thereon from appearing with the image. The scars on the surface of the film 133 caused by the contact with the recording media have little to do with the cumulative number of startups M1, and therefore the cumulative number of printed sheets is not corrected with the cumulative number of startups M1. On the other hand, the cumulative rotation time T1 is used for the lifetime prediction for the fixing apparatus 130 in order to prevent the abrasion on the sliding surfaces of the heater 132 and the film 133 from adversely affecting the image, and it is largely related to the cumulative number of startups M1. Therefore, the cumulative rotation time T1 is corrected with the cumulative number of startups M1, as with Embodiment 1.

Figure 7:
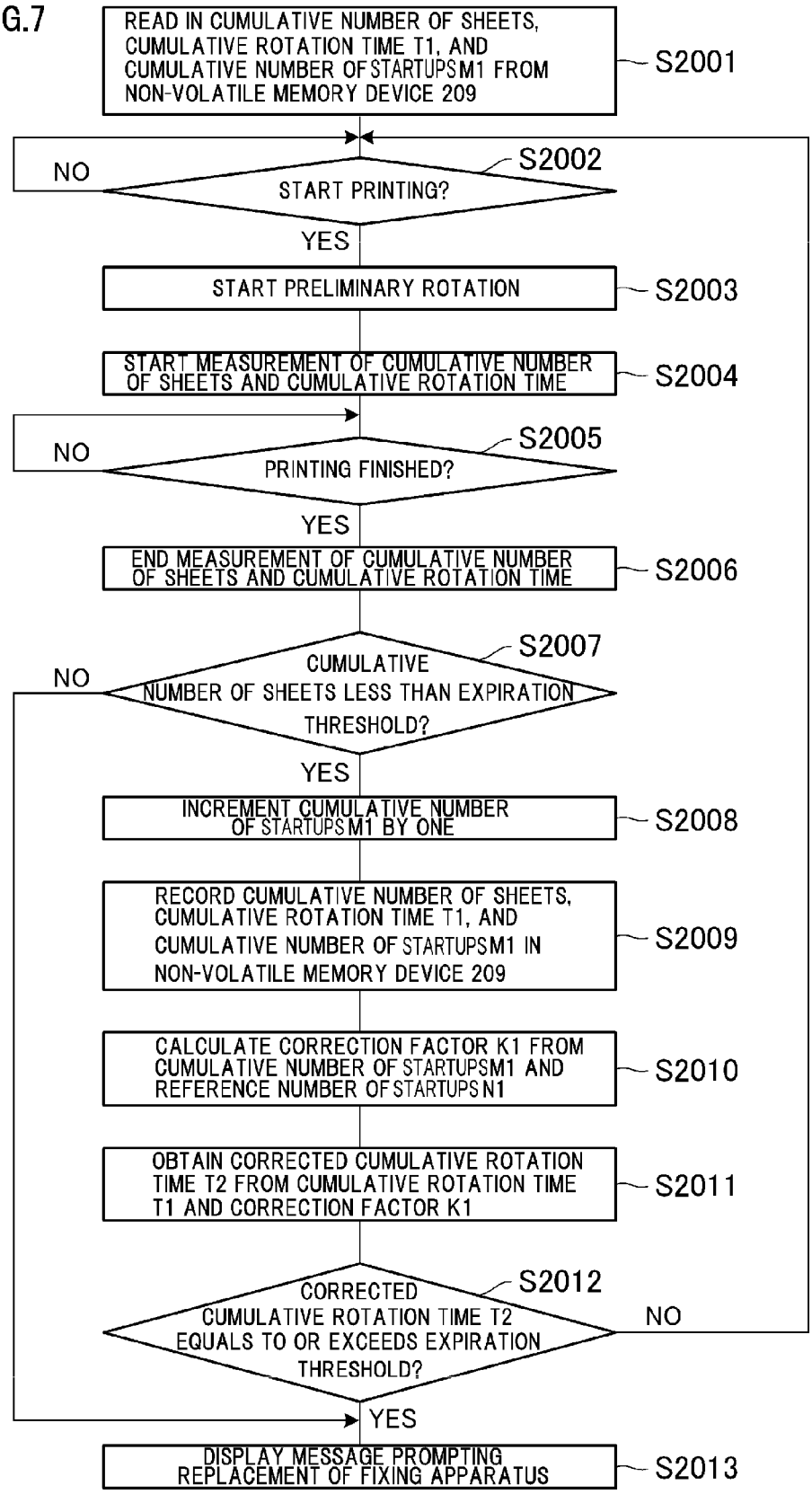
FIG. 7 is a flowchart of a process of predicting the lifetime in a variation example of Embodiment 1.

In the variation example of Embodiment 1, a notifying relating to the lifetime expiration or necessity of replacing the fixing apparatus 130 is implemented at an earlier timing of when the cumulative number of printed sheets reaches a threshold and when the corrected cumulative rotation time T2 reaches a threshold. FIG. 7 shows a flowchart of a process of predicting the lifetime of the fixing apparatus in the variation example of Embodiment 1. Here, only the differences from the flowchart of FIG. 5 according to Embodiment 1 will be described, and the same process steps as those of Embodiment 1 will not be described again. After the completion of the printing action (S2005), and after the completion of determination of the cumulative number of printed sheets and cumulative rotation time (S2006), when the cumulative number of printed sheets has reached an expiration threshold (threshold for the number of sheets), a notifying is implemented to prompt a replacement of the fixing apparatus (S2013). If the cumulative number of printed sheets has not reached the expiration threshold yet, then a sequence follows (S2008 to S2012), wherein the cumulative rotation time T1 is corrected with the cumulative number of startups M1 to obtain a corrected cumulative rotation time T2, which is then compared with the expiration threshold (threshold for the time). This sequence from S2008 to S2012 is the same as S1007 to S1011 in FIG. 5 of Embodiment 1.

In this embodiment and the variation example of the embodiment, the cumulative rotation time T1 that is corrected in accordance with the value of the cumulative number of startups M1 of the fixing apparatus 130 is used for determining the lifetime of the apparatus. Alternatively, the cumulative number of rotations of the rotating member (film 133 or pressure roller 134), or the cumulative time of power application to the heater (heat generating member) may be used instead of the cumulative rotation time T1.

In this embodiment, the drive torque of the fixing apparatus 130 when it is started is indicated as the factor that largely affects the abrasion on the sliding surfaces of the sliding plate (heater 132) and the rotating member (film 133). However, the drive torque of the fixing apparatus 130 when it is started has a large impact also on other parts. If the fixing apparatus has a rotating member that forms a nip portion, various other components of the fixing apparatus may be damaged by the drive torque of the fixing apparatus when it is started. Therefore, the present invention may be applied likewise and the time point of implementing a notifying relating to the lifetime or necessity of replacing the fixing apparatus may be corrected based on the cumulative number of startups of the fixing apparatus, to achieve the same effects as those of this embodiment.

While the pressure roller 134 drives the film 133 to rotate in this embodiment, the invention is not limited to this. The film 133 may be driven by another part. At least one of the film 133 and the pressure roller 134 need be driven, so that the image on the recording medium is heated, as the recording medium is passed through the nip portion N. The image heating device is not limited to the example described above that functions as a fixing apparatus and may be applied as a device that gives a gloss to the toner image fixed on the sheet.

Embodiment 2

Embodiment 2 will be described below.

In Embodiment 1, one mode was described wherein the cumulative rotation time T1 is corrected in accordance with the cumulative number of startups M1 of the fixing apparatus 130 for lifetime prediction. In this embodiment, the information on the drive torque of the fixing apparatus is used in addition to the information on the cumulative number of startups of the fixing apparatus when correcting the information on the lifetime, so as to further improve the accuracy of lifetime prediction. Here, only the differences from Embodiment 1 will be described, and the same parts as those of Embodiment 1 will not be described again.

The amount of abrasion on the sliding surfaces of the fixing apparatus can be predicted based on the information on the cumulative number of startups of the fixing apparatus because the drive torque when starting the fixing apparatus is large. The drive torque at the start varies in accordance with the processing speed of the image forming apparatus, and the temperature of the heater or pressure roller of the fixing apparatus before the printing. If the processing speed of the image forming apparatus is high, the running direction of the fixing film or pressure roller per unit time is long, so that the drive torque at the start of the fixing apparatus is accordingly large, and the sliding surfaces are more prone to abrasion. Commonly, the sliding surfaces are coated with grease, and the higher the temperature of the constituent elements of the fixing apparatus is, the better the lubricity is, which the grease provides. As a result, the drive torque at the start of the fixing apparatus is lower, and the sliding surfaces are more resistant to abrasion.

In this embodiment, therefore, the information on the cumulative number of startups of the fixing apparatus, and the drive torque at the start of the fixing apparatus are used when correcting the lifetime of the fixing apparatus.

Figure 6:
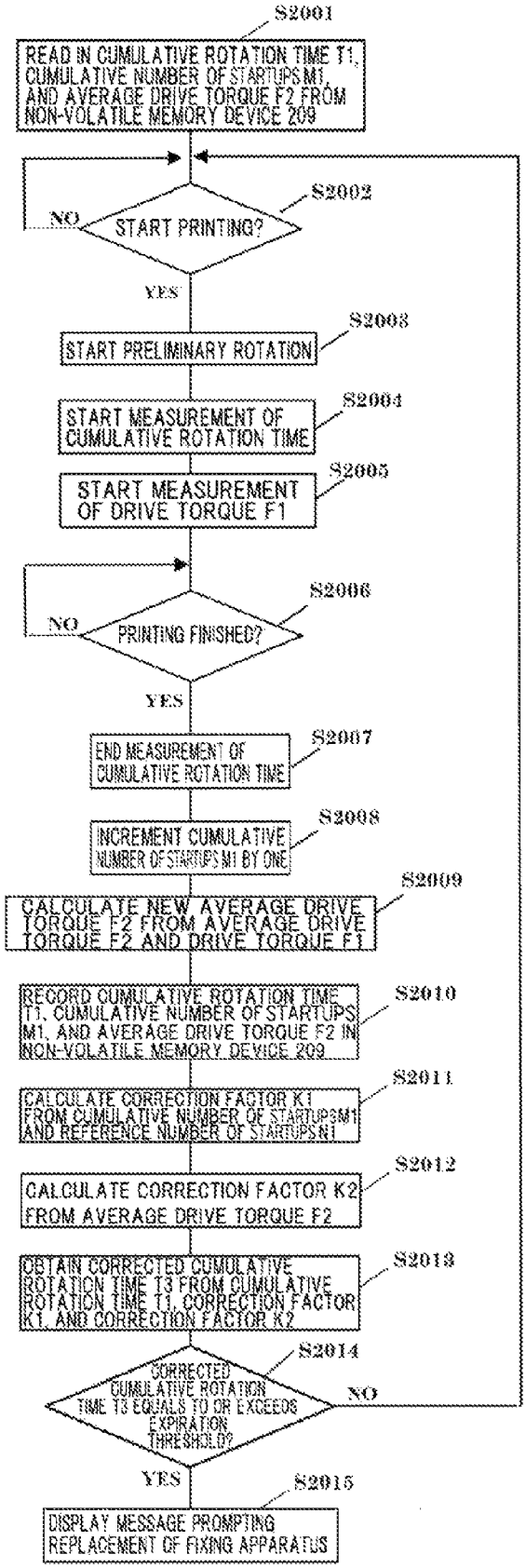
FIG. 6 is a flowchart of a process of predicting the lifetime of the fixing apparatus of Embodiment 2.

FIG. 6 is a diagram showing the flowchart of a process of predicting the lifetime of the fixing apparatus in this embodiment.

The drive torque of the fixing apparatus 130 is measured with the use of a torque measuring device 141. As the drive torque F1, a peak value immediately after the start of the drive torque curve shown in FIG. 3 is adopted. The measurement is made for each job, as indicated in the flowchart of FIG. 6. An arithmetic mean of all the measurement values of the drive torque determined in each job (every time the fixing apparatus 130 was started) is obtained, to be used as an average drive torque F2 for correcting the lifetime.

Note the item "correction factor K2" for correcting the lifetime in the flowchart of FIG. 6. This represents the proneness to abrasion of the sliding surfaces when the average drive torque F2 is large, and indicates how much shorter the lifetime will be as compared to when the torque is a reference average drive torque (reference mean torque, hereinafter, "reference average drive torque F3").

In this embodiment, the corrected cumulative rotation time T2 determined as in Embodiment 1 is multiplied by this correction factor K2 to further correct the corrected cumulative rotation time T2, to obtain a new corrected cumulative rotation time T3 (second corrected lifetime information), to be used for the lifetime determination.

The flowchart of FIG. 6 will be described below in more specific terms. The process shown in the flowchart of FIG. 6 performed by the engine CPU 203 starts when the power of the image forming apparatus 100 is turned on, and ends when the power is turned off.

First, in step S2001, the cumulative number of startups M1, cumulative rotation time T1, and average drive torque F2 stored in the non-volatile memory device 209 are read in. Next, in step S2002, it is decided whether or not the printing action shall be started. The process goes to step S2003 if an instruction to start printing has been received, and returns to step S2002 if not. Next, preliminary rotation is started in step S2003, and at the same time, measurement of the cumulative rotation time T1 is started in step S2004. In step S2005, the drive torque F1 is measured with the use of the torque measuring device 141. In step S2006, it is determined whether or not printing has been finished, and the process goes to step S2007 if printing has been finished, and returns to step S2006 for determination of completion of printing again if printing has not been finished.

In step S2007, as the job is complete, the measurement of the cumulative rotation time T1 is ended. In step S2008, as the job is complete, the cumulative number of startups M1 is incremented by one. In step S2009, a new average drive torque F2 is determined using the arithmetic mean, from the average drive torque F2 read in step S2001 and the drive torque F1 measured in step S2005. The engine CPU 203 that executes step S2009 and determines the average drive torque F2 corresponds to the calculating means. In step S2010, the cumulative rotation time T1, cumulative number of startups M1, and average drive torque F2 are recorded in the non-volatile memory device 209.

In step S2011, the cumulative number of startups M1 is divided by the reference number of startups N1, as shown in Equation (1), to obtain a correction factor K1. In step S2012, the correction factor K2 is obtained by plugging in the value of the average drive torque F2 in Equation (3). Equation (3) will be described later. In step S2013, the cumulative rotation time T1 is multiplied by the correction factor K1 to obtain a corrected cumulative rotation time T2, which is further multiplied by the correction factor K2 to obtain a new corrected cumulative rotation time T3. In step S2014, it is determined, by determination means 208, whether or not the corrected cumulative rotation time T3 has reached an expiration threshold (of, for example, 230 hours). If T3 has reached the threshold, it is determined that the lifetime of the fixing apparatus has expired, and the process goes to step S2015, where replacement of the fixing apparatus is prompted. If T3 has not reached the threshold yet, the process returns to step S2002.

$$\text{Correction factor } K1 = \text{Cumulative number of startups } M1 / \text{Reference number of startups } N1 \quad (1)$$

$$\text{Correction factor } K2 = 232.8/(-28.3 \times \text{Average drive torque } F2 + 445.3) \quad (3)$$

$$\text{Corrected cumulative rotation time } T3 = \text{Cumulative rotation time } T1 \times \text{Correction factor } K1 \times \text{Correction factor } K2 \quad (4)$$

The corrected cumulative rotation time T3 is obtained through such a correction, wherein the corrected cumulative rotation time T2 is further corrected in accordance with the correction factor K2 that is determined based on the average drive torque F2.

If the average drive torque F2 is large, the correction factor K2 is accordingly large, as a result of which the corrected cumulative rotation time T3 is obtained by correcting the cumulative rotation time T2 to be longer than it would be if the correction factor K2 was smaller, so that T3 will reach the expiration threshold earlier. Conversely, if the average drive torque F2 is small, the correction factor K2 is accordingly small, as a result of which the corrected cumulative rotation time T3 is obtained by correcting the cumulative rotation time T2 to be shorter than it would be if the correction factor K2 was larger, so that T3 will reach the expiration threshold later.

This way, the corrected cumulative rotation time T3 is set so that the time point determined as the end of the lifetime of the fixing apparatus 130 is delayed, if the average drive torque F2 is smaller than the reference average drive torque F3. Put differently, the corrected cumulative rotation time T3 is set so that the time point determined as the end of the lifetime of the fixing apparatus 130 is made earlier, if the average drive torque F2 is larger than the reference average drive torque F3.

Equation (3) for obtaining the correction factor K2 is determined based on the results of a paper feeding durability test. The test will be described below.

<Test 3>

It was examined to determine whether or not the cumulative rotation time of the fixing apparatus until the sliding surfaces were abraded would vary if the drive torque of the fixing apparatus was changed during feeding of a large number of sheets.

The image forming apparatus and the fixing apparatus used here were those described in this embodiment. The recording media S used in the test were A4 sheets of paper with 80 g/m$^2$ weight. A job of feeding four sheets of paper successively was repeated. Using the fact that the lubricity of the grease is better when the grease temperature rises, the change in the drive torque of the fixing apparatus was effected by varying the interval between jobs, to change the temperature of the constituent elements of the fixing apparatus. More specifically, the temperature at the back of the heater was measured with the thermistor 138 in the fixing apparatus, and, each time when the temperature at the back of the heater was 30° C., 50° C., 70° C., and 190° C., a subsequent job was started. The temperature of 190° C. at the back of the heater corresponds to an interval of almost zero between the jobs. The drive torque was also measured as sheets of paper were passed during this test, and an average drive torque was also determined. The results are shown in Table 3.

This test shows that, the higher the heater temperature before the printing is, the smaller the average drive torque F2 is, as a result of which the cumulative rotation time T1, with which abrasion occurs on the sliding surfaces, is extended. Table 3 also shows the values of corrected cumulative rotation time T2 determined with the use of Equation (2) of Embodiment 1.

TABLE 3

| Temperature of sliding surfaces before printing | Average drive torque (kg · cm) | Cumulative number of startups M1 with which abrasion occurs on sliding surfaces | Cumulative rotation time T1 with which abrasion occurs on sliding surfaces | Corrected cumulative rotation time T2 |
|---|---|---|---|---|
| 30° C. | 7.51 | 64300 times | 232 hours | 233 hours |
| 50° C. | 6.83 | 66600 times | 250 hours | 250 hours |
| 70° C. | 6.4 | 68300 times | 247 hours | 263 hours |
| 190° C. | 6.23 | 69200 times | 250 hours | 270 hours |

The relationship between the average drive torque F2 and the corrected cumulative rotation time T2 can be determined from these results. This relationship represented by straight-line approximation can be expressed as Equation (5):

$$\text{Corrected cumulative rotation time } T2=-28.3\times\text{Average drive torque } F2+445.3 \quad (5)$$

If the average drive torque is 6.6 (kg·cm), for example, the predicted corrected cumulative rotation time T2 with which abrasion occurs on sliding surfaces is 258.5 hours. It then follows that the notifying relating to lifetime expiration may be made before the corrected cumulative rotation time T2 reaches 258.5 hours.

The correction factor K2 used in this embodiment to further correct the corrected cumulative rotation time T2 can be determined as follows. The correction factor K2 can be determined from the ratio between the corrected cumulative rotation time obtained from the average drive torque F2 by Equation (5), and the corrected cumulative rotation time obtained from the reference average drive torque F3. The reference average drive torque F3 used here is set as 7.51 (kg·cm), which is the average torque in Embodiment 1. Thus, the correction factor K2 can be determined by using the following equation.

$$\text{Correction factor } K2=(-28.3\times7.51+445.3)/(-28.3\times\text{Average drive torque } F2+445.3)=232.8/(-28.3\times\text{Average drive torque } F2+445.3) \quad (3)$$

Equation (3) for obtaining the correction factor K2 was thus determined based on the results of Test 3. Using the results of Test 3, corrected cumulative rotation times T3 were determined and compared.

The results are shown in Table 4.

TABLE 4

| Temperature of sliding surfaces before printing | Average drive torque (kg · cm) | Corrected cumulative rotation time T1 | Correction factor K2 | Corrected cumulative rotation time T3 |
|---|---|---|---|---|
| 30° C. | 7.51 | 233 hours | 1 | 233 hours |
| 50° C. | 6.83 | 250 hours | 0.924 | 233 hours |
| 70° C. | 6.4 | 263 hours | 0.881 | 233 hours |
| 190° C. | 6.23 | 270 hours | 0.865 | 233 hours |

The lifetime is corrected in this way with the use of the average drive torque F2, and it is determined that the lifetime of the fixing apparatus has expired when the corrected cumulative rotation time T3 reaches a threshold (of, for example, 230 hours), whereupon a notifying relating to the lifetime is implemented, so that the user can be prompted to replace the fixing apparatus before the drive torque increases.

According to this embodiment, the accuracy of predicting the lifetime of the fixing apparatus 130 can be further improved as compared to Embodiment 1.

In this embodiment, the average drive torque F2 is determined with the use of a maximum value of the drive torque F1 immediately after the start of the fixing apparatus, based on which the lifetime correction is performed, but the invention is not limited to this. An integrated value of drive torque after the start of the fixing apparatus until the end of the job may be used for the lifetime correction.

While drive torque of the fixing apparatus 130 is measured directly with the torque measuring device 141 in this embodiment, the invention is not limited to this. The drive torque of the fixing apparatus 130 is correlated to the drive current of the fixing motor 140 for driving the fixing apparatus 130. Therefore, the drive current of the fixing motor 140 that drives the fixing apparatus 130 may be measured with the use of a fixing motor drive current measuring device 142, and a maximum value or an integrated value of the drive current may be used to assume the drive torque of the fixing apparatus 130. For further cost reduction, the drive torque could also be assumed from the status of the fixing apparatus 130, even without using the torque measuring device 141 or the fixing motor drive current measuring device 142. Since the drive torque varies depending on the throughput of the image forming apparatus 100 and the temperature of the constituent elements of the fixing apparatus 130 such as the heater or pressure roller, the drive torque of the fixing apparatus 130 may be assumed from the values of these parameters.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-041815, filed Mar. 4, 2014, No. 2015-032919, filed Feb. 23, 2015, which are hereby incorporated by reference herein in their entirety.

What is claimed is:

1. An image forming apparatus that forms a toner image on a recording medium, comprising:

an image forming unit configured to form an unfixed toner image on the recording medium;

a fixing unit configured to fix the unfixed toner image on the recording medium while conveying the recording medium bearing the unfixed toner image at a nip portion, the fixing unit including a fixing rotating member and a pressure member forming the nip portion with the fixing rotating member;

a counting portion configured to count a cumulative rotation time of the fixing rotating member and a cumulative number of startups of said fixing unit; and a notifying portion configured to perform a notification of information about at least one of the expiration of the lifetime of the fixing unit and the necessity of replacing the fixing unit, wherein the cumulative rotation time is corrected such that, the larger the cumulative number of startups of said fixing unit, the longer the cumulative rotation time, and wherein the notifying portion performs the notification of the information in accordance with the cumulative rotation time that has been corrected.

2. The image forming apparatus according to claim 1, wherein the notifying portion performs the notification of the information when the cumulative rotation time that has been corrected reaches a threshold time.

3. The image forming apparatus according to claim 1, wherein the fixing rotating member is a tubular film, and wherein the fixing unit includes a nip forming member contacting an inner surface of the film and forming the nip portion with the pressure member via the film.

4. The image forming apparatus according to claim 3, wherein the film includes a base layer made of metal.

5. The image forming apparatus according to claim 3, wherein the nip forming member is a heater.

6. An image forming apparatus that forms a toner image on a recording medium, comprising:

an image forming unit configured to form an unfixed toner image on the recording medium;

a fixing unit configured to fix the unfixed toner image on the recording medium while conveying the recording medium bearing the unfixed toner image at a nip portion, the fixing unit including a fixing rotating member and a pressure member forming the nip portion with the fixing rotating member;

a counting portion configured to count a cumulative rotation time of the fixing rotating member, a cumulative number of startups of the fixing unit, and a cumulative number of printed sheets; and a notifying portion configured to perform a notification of information about at least one of the expiration of the lifetime of the fixing unit and the necessity of replacing the fixing unit, wherein the cumulative rotation time is corrected such that the larger the cumulative number of startups of the fixing unit, the longer the cumulative rotation time, and wherein the notifying portion performs the notification of the information at the earlier of the time when the cumulative number of printed sheets reaches a threshold number and the time when the cumulative rotation time that has been corrected reaches a threshold time, whichever takes place earlier.

7. The image forming apparatus according to claim 6, wherein the fixing rotating member is a tubular film, and wherein the fixing unit includes a nip forming member contacting an inner surface of the film and forming the nip portion with the pressure member via the film.

8. The image forming apparatus according to claim 7, wherein the film includes a base layer made of metal.

9. The image forming apparatus according to claim 7, wherein the nip forming member is a heater.

10. An image forming apparatus that forms a toner image on a recording medium, comprising:

an image forming unit that forms an unfixed toner image on the recording medium;

a fixing unit configured to fix the unfixed toner image on the recording medium while conveying the recording medium bearing the unfixed toner image at a nip portion, the fixing unit including a fixing rotating member and a pressure member forming the nip portion with the fixing rotating member;

a counting portion configured to count a cumulative number of rotations of the fixing rotating member, a cumulative number of startups of the fixing unit, and a cumulative number of printed sheets; and a notifying portion configured to perform a notification about information about at least one of the expiration of the lifetime of the fixing unit and the necessity of replacing said fixing unit, wherein the cumulative number of rotations is corrected such that, the larger the cumulative number of startups of the fixing unit, the larger the cumulative number of rotations, and wherein the notifying portion performs a notification of the information at the earlier of the time when the cumulative number of printed sheets reaches a threshold sheet number and the time when the cumulative number of rotations that has been corrected reaches a threshold rotation number, whichever takes place earlier.

11. An image forming apparatus that forms a toner image on a recording medium, comprising:

an image forming unit configured to form an unfixed toner image on the recording medium;

a fixing unit configured to fix the unfixed toner image on the recording medium while conveying the recording medium bearing the unfixed toner image at a nip portion, the fixing unit including a fixing rotating member and a pressure member forming the nip portion with the fixing rotating member;

an acquisition portion configured to acquire a cumulative number of rotations of the fixing rotating member and a cumulative number of startups of said fixing unit; and a notifying portion configured to perform a notification of information about at least one of the expiration of the lifetime of the fixing unit and the necessity of replacing the fixing unit, wherein the cumulative number of rotations is corrected according to the cumulative number of startups of said fixing unit, and wherein the notifying portion performs the notification of the information in accordance with the cumulative number of rotations that has been corrected.

12. An image forming apparatus that forms a toner image on a recording medium, comprising:

an image forming unit configured to form an unfixed toner image on the recording medium;

a fixing unit configured to fix the unfixed toner image on the recording medium while conveying the recording medium bearing the unfixed toner image at a nip portion, the fixing unit including a fixing rotating member and a pressure member forming the nip portion with the fixing rotating member;

an acquisition portion configured to acquire a cumulative rotation time of the fixing rotating member and a cumulative number of startups of said fixing unit; and a notifying portion configured to perform a notification of information about at least one of the expiration of the lifetime of the fixing unit and the necessity of replacing the fixing unit, wherein the cumulative rotation time is corrected according to the cumulative number of startups of said fixing unit, and wherein the notifying portion performs the notification of the information in accordance with the cumulative rotation time that has been corrected.

* * * * *